US006923774B2

(12) United States Patent
Roy

(10) Patent No.: US 6,923,774 B2
(45) Date of Patent: Aug. 2, 2005

(54) MOBILE RADIOLUSCENT CARDIAC MASSAGE ASSEMBLY

(75) Inventor: Vipul Narain Roy, 40 Dr Atul Roy 18154 Trufle Lane, Boyds, MD (US) 20841

(73) Assignee: Vipul Narain Roy, New Delhi (IN)

( * ) Notice: Subject to any disclaimer, the term of this patent is extended or adjusted under 35 U.S.C. 154(b) by 164 days.

(21) Appl. No.: 10/231,232

(22) Filed: Aug. 30, 2002

(65) Prior Publication Data

US 2003/0050577 A1 Mar. 13, 2003

(51) Int. Cl.[7] ..... A61H 31/00
(52) U.S. Cl. ..... 601/41; 601/107
(58) Field of Search ..... 601/41, 44, 153, 601/42, 43, 106, 107, 134, 135; 606/192, 198, 185; 600/18, 207; 607/142; 128/845, 205.18, 205.25, 202.16

(56) References Cited

U.S. PATENT DOCUMENTS

| | | | | | |
|---|---|---|---|---|---|
| 2,633,124 | A | * | 3/1953 | Yellin | 602/36 |
| 3,241,551 | A | * | 3/1966 | Tambascia | 601/41 |
| 3,965,893 | A | * | 6/1976 | Ragailler | 601/106 |
| 4,338,924 | A | * | 7/1982 | Bloom | 601/41 |
| 5,184,606 | A | * | 2/1993 | Csorba | 601/41 |
| 5,257,619 | A | * | 11/1993 | Everete | 601/41 |
| 5,632,726 | A | * | 5/1997 | Repice et al. | 602/36 |
| 6,258,047 | B1 | * | 7/2001 | Muramatsu | 600/594 |
| 6,648,841 | B1 | * | 11/2003 | Sessler | 601/41 |

* cited by examiner

*Primary Examiner*—Justine R. Yu
*Assistant Examiner*—Quang D. Thanh

(57) ABSTRACT

An indirect massage assembly that can work within seconds and can safely be used cine/fluoroscopy. It preserves the sterility of the operative field.

8 Claims, 1 Drawing Sheet

MOBILE RADIOLUSCENT CARDIAC MASSAGE ASSEMBLY

SPECIFICATION

Figure 1:
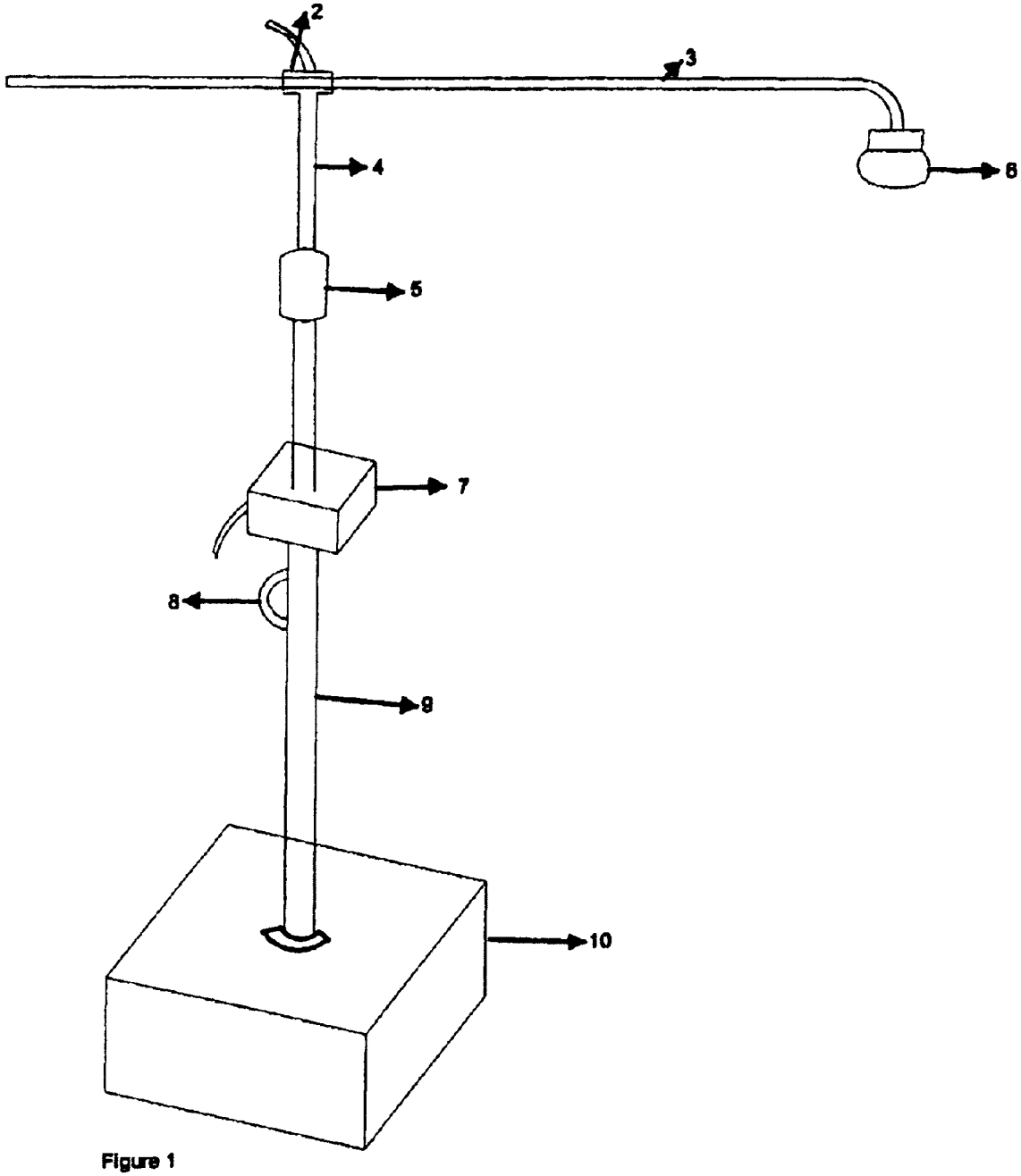

Complete specification for pursuance of patent application Ser. No. 60/318,277 dated 11th Sep. 2001 filed as provisional application

CROSS REFERENCE TO RELATED APPLICATIONS

No. 60/318,277 dated Sep. 11, 2001

FEDERALLY SPONSORED RESEARCH OR DEVELOPMENT

Not applicable

REFERENCE TO SEQUENCE LISTING, A TABLE, OR A COMPUTER PROGRAM LISTING COMPACT DISK APPENDIX

Not applicable

BACKGROUND TO INVENTION

Problem

If at existing level of technology, a patient requires cardiac massage while interventional cardiac procedure is continuing, paramedical staff of cardiac catheter lab has to take dangerous doses of radiation in their hands and fingers. Note—Use of lead gloves is not possible here unlike other procedures as it will obscure the view of the operator.

During procedure since massage is stopped, patient's vital organs (heart, brain, kidney and liver) are subjected to anoxic damage and thus reducing chances of revival drastically. As a result increasing the incidence of death, cerebral damage, ventricular dysfunction, renal and liver damage This serious problem affects proper cardiac massage and the resultant outcome Note—Due to lack of a proper device there is excess use of Intra Aortic Balloon Counterpulsation and Percutaneous extra corporeal circulation, but even this has to be bridged with cardiac massage and interventional procedure has to stop affecting outcome, These devices are also very costly needing trained manpower and each time use requires consumables costing more than $1000=00.

In certain operative procedures cardiac massage results in an unacceptable incidence of nosocomial infections.

This assembly has been designed to solve above problem. This solution is more effective than IABP or extracorporeal circulation, at the same time very cheap than these two to install and no cost of extra consumable or trained manpower.

BRIEF SUMMARY OF INVENTION

Note timely started and continued cardiac massage till reasonable haemodynamic recovery is single most important variable in patients recovery It is compromised in following situations 1—In cathlab Dangerous dose of radiation to hands and fingers of staff 2—In theatre Nosocomial infections in survivors With the current assembly there is a mobile system which takes a couple of seconds to start the massage. This can continue during the fluoroscopy or cine runs and does not affect the sterility of the field.

With the assembly above problems are solved and it is maintenance free and expected to last a century.

BRIEF DESCRIPTION OF SEVERAL VIEWS OF DRAWING

The figures are on color for better expression of prototype one but since prtotype 2 is a mobile and has independent base from cath-lab table it is in black and white

DETAILED DESCRIPTION OF THE INVENTION

Vipul's Mobile Radioluscent Indirect Cardiac Massage Assembly

Problem

If at existing level of technology a patient requires cardiac massage while interventional cardiac procedure is continuing, paramedical staff of cardiac catheter lab has to take dangerous doses of radiation in their hands and fingers. Note—Use of lead gloves is not possible here unlike other procedures as it will obscure the view of the operator.

This serious problem affects proper cardiac massage and the resultant outcome

Note—Due to lack of a proper device there is excess use of IABP and percutaneous extracorporeal circulation, but even this has to be bridged with cardiac massage and interventional procedure has to stop affecting outcome.

In certain operative procedures, where drapes cover upper abdomen and lower chest if cardiac arrest occurs the cardiac massage results in an unacceptable incidence of nosocomial infections.

This assembly has been designed to solve above problem.

Initially first prototype(prototypeI) was made and tried as per earlier application (Ser. No. 60/318,277 dt Sep. 11, 2001).

Changes from Prototype 1

Following changes have been made to the device prototype 1 to solve the problems mentioned below.

Precious time was lost in setting the clamp on the table (note it was earlier planned this way so as not to lose the valuable space on one side of table), adjusting the vertical height, adjusting pivot for horizontal movement, there was injury to fingers and even the up and down movement was not satisfactory.

Note—changes from the prototype I were done with following objectives

1 Assembly should work within a couple of seconds to save time

2 Final product should be very strong and user friendly

3 Above finger injury substrates to be removed

4 Assembly should be maintenance free with expected life of over 100 years.

Modification 1

Vertical movement is set by using a wise and the horizontal movement by a special top handle, both of which are very easy and fast to use.

But these finer requirements will not be required in most patients.

I found that using this kind of steel wise in the prototype and horizontal moving clamp saved time, if required at all.

Modification 2

Adding a nylon grip and handle to the vertical height adjustment shaft made using the device further more easier and faster, it also avoids injury to fingers. It also helped with a good grip while moving the base. In this nylon grip if I added finger serrations, this tended to accumulate dirt etc that was relatively difficult to clean.

Modification 3

The long spring gives wide range of freedom in vertical height and vertical height adjustment will rarely be required. In rare situations where this vertical height changes are required the procedure need not be stopped for any adjustment if required. The spring has been given a wider part so that it can not come out and yet give rotation in 360 degrees.

Modification 4

Horizontal bar has been changed to square/oval/steel slit to avoid rotation. In these the square bar was easiest to use.

Modification 5

Massage hub has been designed so that it works simply and efficiently even if the device is kept at an angle from the patient. I tried few options of attaching it to the steel horizontal bar and found that the threading was simple and very easy to rotate to align to sternum if the assembly is at an angle to the patient. This also saves time and makes it more efficient.

Attempt was made to make horizontal bar totally of nylon so that entire bar is radioluscent but at the required thickness it was not offering long term strength and durability as steel will offer Modification 6

Change in base sizes:

$1^{st}$ size tried was (45×45)cm $2^{nd}$ size tried was (46.5×51.5)cm—(size of present prototype)

$3^{rd}$ size tried was (90×30)cm $4^{th}$ size tried was (10×10)cm

Note in prototype I, the base was sacrificed to the anchor to preserve the space but I realized that precious time was being lost.

2nd Addition of this larger base gave the advantage that that the assembly user did not need any stool if he so desired the base could be used for standing so he can work with or without stool. With this no anchoring clamp is required and assembly can be used at an angle to the patient.

$1^{st}$ In first size of base the assembly user tended to fall if he decided to use the assembly as stool.

$4^{th}$ The assembly was unstable.

$3^{rd}$ Size being quite larger gave stability in all respects. Although by increasing the size to the third value(90×30)cm gave extra stability it was unpractical as a lot of working space was lost on one side of the patient and the device cannot be used at an angle to the patient.

Modification 7

On any removable part chain has been attached so that no part can be removed from the assembly. Any part will not be lost.

Modification 8

In massage hub strong Rexene was used in the bottom part as it did not absorb any fluid. Strong leather has been also used to anchor it to the hub.

Note Person using the assembly can see chest depression/invasive pressure for optimal monitoring. He can also ask someone to feel the pulse.

Sterile drape can be rolled over in second. If required.

The assembly is transmitting the force generated by the human operator so very low or high pressures are not generated and transmitted.

Note that all parts are made up of high quality very strong stainless steel. At massage hub and hand holding expensive nylon is used. The wheel is made up of high quality nylon.

This equipment is designed to work within seconds and massage will continue while any finer adjustment is made if required. Thus you have maintenance free equipment, which is expected to last more than hundred years of use.

(Up to modification 8 the changes have been made in the present prototype)

Changes under consideration/already planned for $3^{rd}$ prototype

Wheels on both side of base to make movement faster and easier. Note better quality wheel source located.

In horizontal bar the steel shaft will be around 5 cms in length after the bend so that excessive magnification of coronary images in some views is avoided. Note this will be seen if it is affecting the durability and long term strength of assembly as above problem is not a major problem.

Horizontal bar to be thinner in dimensions with shorter screw.

Improve Horizontal Anchor

Anchor horizontal movement adjustment handle with chain.

Chain attached to horizontal bar will be attached at the back end with a small knob in a way that it can cross through the anchor to facilitate transport and packing.

Spring to offer 30 cms in vertical movement.

Add nut seal in hand grip for cleanliness and tampering will be difficult

Massage hub-Leather with coating (hydrophobic coating)

Rexene to be attached to the leather at bottom upwards

Nylon to be thinner for radioluscency/alternatively plastic or some other semicompliant material Use serration (2 in no) in plastic/nylon and nylon chord for suturing instead of steel wire Hub and whole assembly to be made aesthetically better

I claim:

1. A radioluscent cardiac massage assembly for providing a radioluscent direct cardiac massage on chest wall and indirectly by an operator using a horizontal bar with respect to a vertical column, said assembly comprising:

a base comprising wheels, wherein the base can support the assembly and body weight of the operator and wherein the base is solid for operator's stability;

wherein on the base is permanently mounted a stabilizing column, at the top of the stabilizing column is mounted a steel wise, on top of the steel wise is mounted a vertical height adjustment column, on the top end of the height adjustment column is mounted a column loaded with a spring, on top of the spring loaded column is mounted a horizontal bar rotatable 360 degree with respect to the vertical column, at the end of the horizontal bar is a massage hub which has two parts, a top part that is solid radioluscent material and a bottom part that as made of material that is collapsible, soft and does not absorb any fluid to maintain sterility.

2. Radioluscent cardiac massage assembly of claim 1, wherein the base functions as a built-in stool.

3. The radioluscent cardiac massage assembly of claim 1, wherein the base with wheels makes the assembly mobile.

4. The radioluscent cardiac massage assembly of claim 1, wherein the stabilizing column is provided with a handle.

5. The radioluscent cardiac massage assembly of claim 1, wherein the vertical height adjustment column is provided with a with a hand grip.

6. The radioluscent cardiac massage assembly of claim 1, wherein there is a free 360 degree rotation bar system without spring coming out.

7. The radioluscent cardiac massage assembly of claim 1, wherein the device can work at an angle to the patient.

8. The radioluscent cardiac massage assembly of claim 1, wherein the assembly is permanently assembled but movable and at a time of need is usable within seconds from any angle to the patient.

* * * * *